US006901763B2

(12) United States Patent
Memory et al.

(10) Patent No.: US 6,901,763 B2
(45) Date of Patent: Jun. 7, 2005

(54) REFRIGERATION SYSTEM

(75) Inventors: Stephen B. Memory, Kenosha, WI (US); Jianmin Yin, Kenosha, WI (US); Samuel J. Collier, Danville, KY (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/602,276

(22) Filed: Jun. 24, 2003

(65) Prior Publication Data

US 2004/0261449 A1 Dec. 30, 2004

(51) Int. Cl.[7] ..... F25B 41/00
(52) U.S. Cl. ..... 62/113; 62/503; 62/513
(58) Field of Search ..... 62/113, 503, 513

(56) References Cited

U.S. PATENT DOCUMENTS

| | | | | | |
|---|---|---|---|---|---|
| 2,637,983 | A | * | 5/1953 | Malkoff et al. | 62/278 |
| 2,799,999 | A | * | 7/1957 | Swanson | 62/503 |
| 2,801,523 | A | * | 8/1957 | Hansen | 62/151 |
| 3,283,524 | A | | 11/1966 | Byron | |
| 3,552,140 | A | | 1/1971 | Palmer | |
| 3,600,904 | A | | 8/1971 | Tilney | |
| 3,938,349 | A | | 2/1976 | Ueno | |
| 4,702,086 | A | * | 10/1987 | Nunn et al. | 62/113 |
| 6,233,969 | B1 | * | 5/2001 | Yamauchi et al. | 62/513 |
| 6,434,972 | B1 | * | 8/2002 | Geiger et al. | 62/513 |
| 6,481,243 | B1 | * | 11/2002 | Fang et al. | 62/513 |
| 6,523,360 | B2 | * | 2/2003 | Watanabe et al. | 62/204 |
| 6,681,597 | B1 | | 1/2004 | Yin et al. | |
| 2002/0078698 | A1 | | 6/2002 | Leisenheimer et al. | |
| 2002/0157407 | A1 | | 10/2002 | Weng | |
| 2004/0112073 | A1 | | 6/2004 | Ito et al. | |

FOREIGN PATENT DOCUMENTS

| | | |
|---|---|---|
| DE | 1 807 881 | 6/1969 |
| DE | 35 45 013 A1 | 6/2002 |
| EP | 0 779 481 A2 | 6/1997 |
| EP | 0 803 688 A2 | 10/1997 |
| EP | 0 841 487 A2 | 5/1998 |
| EP | 1 445 551 | 8/2004 |
| JP | 6-137719 | 5/1994 |
| JP | 8-5204 | 1/1996 |
| JP | 10-19421 | 1/1998 |
| JP | 10-160293 | 6/1998 |
| WO | WO 03/042605 A1 | 5/2003 |

OTHER PUBLICATIONS

PCT International Search Report dated Oct. 7, 2004.

D. Boewe et al, "The Role of Suction Line Heat Exchanger in transcritical R744 Mobile A/C Systems", SAE World Congress, Mar. 1, 1999, pp. 1–8, XP–001169088.

G. Haunhort et al, "System and Service Components for Carbon Dioxide Air Conditioning Systems Easton Fluid Power, Automotive Fluid Connectors", SAE Automotive Alternate Refrigerant Systems Symposium, Jul. 2002, pp. 1–36, XP001169128.

T. Pfafferott et al, "Modelling and transient simulation of $CO_2$–refrigeration systems with Modelica", International Journal of Refrigeration, Oxford, GB, vol. 27, No. 1, Jan. 2004, pp. 42–52, XP004469670.

* cited by examiner

*Primary Examiner*—William E. Tapolcai
(74) *Attorney, Agent, or Firm*—Wood, Phillips, Katz, Clark & Mortimer

(57) ABSTRACT

The efficiency of refrigeration systems operating on the vapor compression cycle and employing suction line heat exchangers is increased by introducing refrigerant into the lower pressure side of the suction line heat exchanger at a quality less than 1 and introducing refrigerant that has passed through the low pressure side of the suction line heat exchanger into the compressor inlet at a quality that is equal to 1.

15 Claims, 2 Drawing Sheets

REFRIGERATION SYSTEM

FIELD OF THE INVENTION

This invention relates to refrigeration systems, and more particularly, to refrigeration systems that include components operating on the vapor compression cycle for cooling a refrigerant and which are provided with suction line heat exchangers.

BACKGROUND OF THE INVENTION

Refrigeration systems such as heat pump systems used for heating and cooling, air conditioning systems used for cooling air, refrigerators and freezers and the like most in use today operate on the so-called vapor compression principle. In these systems, a refrigerant is compressed by a compressor and then passed to a gas cooler (including condensers) to cool and/or condense the compressed refrigerant while at high pressure. The high pressure refrigerant is then passed to an expansion device such as a capillary or an expansion valve and then to an evaporator at a lower pressure where the refrigerant absorbs the latent heat vaporization of the refrigerant and/or sensible heat.

The refrigerant then exits the evaporator and is returned to the inlet of the compressor at low pressure to be compressed so that the cycle can be repeated continuously.

Most such systems include an accumulator somewhere in the path between the evaporator and the compressor which principally serves to contain excess refrigerant to assure that the system is always charged with sufficient refrigerant to operate. Many such systems, particularly those operating on a transcritical refrigerant such as $CO_2$ also include a so-called suction line heat exchanger. Such suction line heat exchangers (also sometimes referred to as internal heat exchangers) may also be found in very large systems employing more or less conventional refrigerants and in systems of more modest size operating with the refrigerant commonly known as R134*a*.

A suction line heat exchanger includes two fluid flow paths in heat transfer relation with one another. One of the flow paths typically interconnects the gas cooler of the system with the evaporator at a location upstream of the expansion device and downstream of the gas cooler. The other flow path is located in the path of refrigerant flow between the evaporator and the inlet of the compressor.

In systems using more or less conventional refrigerants, the presence or absence of a suction line heat exchanger depends upon whether the added efficiency produced by the presence of the suction line heat exchanger is sufficient to offset the cost of the suction line heat exchanger itself and whether the system, when installed in its operating environment, can tolerate the bulk, both in terms of volume and in weight, of an additional heat exchanger. A system typical of the latter situation is one that may be employed in a vehicular application such as an automotive air conditioner.

On the other hand, when operating with transcritical refrigerants such as $CO_2$, suction line heat exchangers are considered almost a virtual necessity in spite of their cost, weight or bulk because of the considerable improvement in efficiency that is obtained with them with such refrigerants.

Given modern day concerns for energy and the cost thereof, it is highly desirable that such a refrigeration system be as efficient as possible so as to minimize the expense of energy. The present invention is directed to improving the efficiency of a vapor compression refrigeration system including a suction line heat exchanger by obtaining even higher levels of efficiency than those obtainable with today's technology.

SUMMARY OF THE INVENTION

It is the principal object of the invention to provide a new and improved refrigeration system of the vapor compression type that employs a suction line heat exchanger by increasing the efficiency thereof. It is also a principal object of the invention to provide a new and improved method of operating a vapor compression refrigeration system of the type employing a suction line heat exchanger.

According to one object of the invention, there is provided a refrigeration system that includes a compressor having an inlet and an outlet, a gas cooler connected to the compressor outlet to cool compressed refrigerant received from the compressor and an evaporator connected to the gas cooler for receiving cooled, compressed refrigerant therefrom. The system includes a suction line heat exchanger which has a first refrigerant flow path interconnecting the gas cooler and the evaporator and a second refrigerant flow path in heat exchange relation with the first refrigerant flow path and interconnecting the evaporator and the inlet of the compressor. The system including the evaporator is constructed to deliver refrigerant from the evaporator to the second refrigerant flow path in the suction line heat exchanger at a quality less than 1 and to deliver refrigerant from the second flow path of the suction line heat exchanger to the inlet of the compressor at a quality substantially equal to 1 or in a super heated condition.

In one embodiment of the invention, an accumulator is located in the system and is located downstream of the second flow path and upstream of the inlet of the compressor.

In another embodiment of the invention, the system is provided with a compressor, a gas cooler and an evaporator as before. An accumulator is connected to the evaporator to receive refrigerant therefrom and a suction line heat exchanger is located in the system and has a first refrigerant flow path interconnecting the gas cooler and the evaporator and a second refrigerant flow path in heat exchange relation with the first refrigerant flow path and interconnecting the accumulator and the compressor inlet and receiving refrigerant from the accumulator at a quality less than 1 and delivering the refrigerant to the compressor inlet at a quality substantially equal to 1 or in a super heated condition.

According to the foregoing embodiment of the invention, the accumulator is a housing having an intended level of liquid refrigerant and a refrigerant vapor space above the intended level of liquid refrigerant. A first outlet from the accumulator is disposed above the intended level of liquid refrigerant and a second outlet from the accumulator is located below the intended level of liquid refrigerant. The first and second outlets are in fluid communication with each other and with the compressor inlet.

In a preferred embodiment, an accumulator such as mentioned before is constructed so that liquid refrigerant within the accumulator is entrained or educed into the refrigerant vapor.

One embodiment of the invention contemplates that the second outlet of the accumulator is disposed in a wall of the housing separate from the first outlet.

Preferably, the accumulator includes a tube within the housing and both the outlets comprise respective inlet ports in the tube.

In one embodiment, the inlet port defining the first outlet is upstream of the inlet port defining the second outlet to provide entrainment and/or eduction of the liquid refrigerant.

A highly preferred embodiment contemplates that the tube be a "U" or "J"-shaped tube having a first leg having the first inlet therein at a location above the intended level of liquid refrigerant and a second leg connected to the first leg by a bight and having the second outlet below the intended level of liquid refrigerant.

In such an embodiment, the accumulator may also include an intended level of system lubricant below the intended level of refrigerant liquid and the bight is located below the intended level of system lubricant and includes a system lubricant inlet port therein. According to this embodiment, lubricating oil from the system is also educed from the accumulator by the flow of refrigerant vapor therefrom.

According to another facet of the invention, there is provided a method of increasing the efficiency of a system including a vapor compression cooling cycle and having an evaporator with an inlet connected to an outlet of a gas cooler whose outlet in turn is connected to the inlet of a compressor. The compressor has an outlet connected to the inlet of the gas cooler and a suction line heat exchanger having two fluid flow paths in heat exchange relation with one another is provided. One of the flow paths is located between the evaporator inlet and the compressor outlet and the other flow path is located between the evaporator outlet and the compressor inlet. Refrigerant is located in the system and is of the type that may exist as a vapor, a liquid or a mixture of vapor and liquid whose quality at a given point is defined as the weight ratio of the mass of refrigerant vapor to the combined mass of refrigerant vapor and liquid refrigerant at the given point. The method includes the steps of (a) introducing refrigerant into the other flow path of the suction line heat exchanger at a quality less than 1; and (b) introducing refrigerant that has passed through the second flow path into the compressor inlet at a quality that is substantially equal to 1 or in a super heated condition.

According to the invention, a method of operating a refrigeration system having a vapor compression cooling cycle and of the type generally described previously includes the steps of (a) introducing refrigerant from an evaporator outlet into an accumulator; (b) discharging refrigerant having a quality less than 1 from the accumulator into the other flow path of the suction line heat exchanger; and (c) introducing refrigerant having a quality substantially equal to 1 or super heated vapor from the other flow path into the compressor inlet.

In one embodiment of the invention, the step of discharging refrigerant having a quality less than 1 from the accumulator into the other flow path of the suction line heat exchanger is performed by entraining or educing liquid refrigerant from the accumulator by refrigerant vapor exiting the accumulator to the compressor inlet.

In one embodiment, the latter step is performed within the accumulator while in another embodiment, the latter step is performed downstream of the accumulator.

Other objects and advantages will become apparent from the following specification taken in connection with the accompanying drawings.

DESCRIPTION OF THE PREFERRED EMBODIMENT

Preferred embodiments of a refrigeration system made according to the invention and methods of operating the same will be described herein principally in the environment of so-called vehicular air conditioning systems. However, it is to be understood that the principles of the invention may be employed with efficacy in cooling cycles utilized in heat pumps, and in refrigeration systems generally, including refrigerators, freezers and other cooling devices as, for example, cooling systems for electronic components. Further, the invention is also useful in non-vehicular applications as well. Consequently, no limitation as to any particular type of refrigeration system or particular environment of use is intended except insofar as specifically stated in the appended claims.

Reference herein will be made to certain terms as, for example, the "quality of the refrigerant". Quality is as conventionally defined, namely, the weight ratio of the mass of refrigerant in the vapor phase to the total mass of refrigerant, i.e., the combined mass of liquid refrigerant and refrigerant vapor, at a given point in the system. Thus, refrigerant wholly in the vapor phase will have a quality of 1 while refrigerant wholly in the liquid phase will have a quality of zero. Refrigerant that is both in the liquid and vaporous phase will have a quality greater than zero and less than 1, the exact number being determined by the ratio of refrigerant vapor to total refrigerant.

A quality "substantially equal to 1" is a refrigerant having a quality of 1 or possibly slightly less. The quality will be such that liquid refrigerant present, if any, will be insufficient to cause damage to the system compressor. The deviation from a quality of 1 that is tolerable will depend on both the compressor and refrigerant used in the system.

A quality of "less than 1" means a refrigerant that contains sufficient liquid refrigerant that, if passed to the system compressor, could damage the compressor.

The term "gas cooler" is intended to include condensers.

The terms "eduction" and "entrainment" are used interchangeably.

Figure 1:
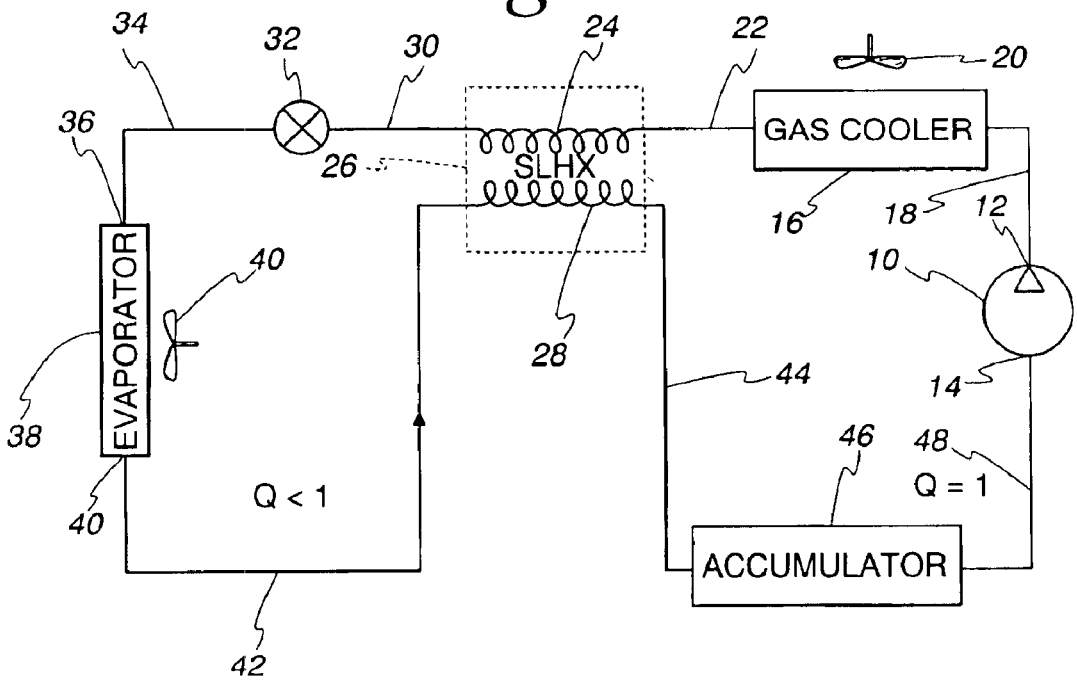
FIG. 1 is a schematic of one form of vapor compression system made according to the invention.

With the foregoing in mind, embodiments of the invention will be described. With reference to FIG. 1, the same is seen to include a compressor 10 for a refrigerant. The compressor 10 includes an outlet 12 and inlet 14. The outlet 12 is connected to an air/gas or liquid heat exchanger in the form of a gas cooler 16. Compressed refrigerant from the compressor flows in a line 18 to the gas cooler where is it cooled and/or condensed, typically by air, flowed through the gas cooler 16 by means of a fan 20 or the like. However, cooling for the refrigerant can be accomplished by other means as, for example, by using a liquid coolant.

From the gas cooler, the compressed refrigerant at high pressure passes in a line 22 to a first flow path 24 within a suction line heat exchanger 26. The suction line heat exchanger also includes a second flow path 28 which is in heat exchange relation with the first flow path 24.

From the first flow path 24, the refrigerant is connected by a suitable conduit 30 to an expansion device 32 which may be in the form of an expansion valve, a capillary tube, or any other type of expansion device usable in refrigeration systems. The expansion device 32 reduces the pressure of a refrigerant which is then passed along a conduit 34 to the inlet 36 of an evaporator 38. As shown, the evaporator 38 is an air/liquid heat exchanger and the liquid refrigerant, now at low pressure, is evaporated by means of an air stream passed through the evaporator 38 by a fan 40. Within the evaporator 38, the latent heat of evaporation as well as sensible heat is rejected to the air stream generated by the fan 40. Of course, the latent heat and sensible heat of the refrigerant could be rejected to a liquid coolant, if desired.

Evaporated refrigerant emerges from the evaporator 38 at an outlet 40 and is conducted by a conduit 42 to the second flow path 28 of the suction line heat exchanger 26. According to the invention, refrigerant emerging from the evaporator 38 at the outlet 40 and entering the second flow path 28 is at a quality less than one. Qualities as high as 0.9–0.95 provide increased efficiency of the system as will be described. However, increases in efficiency are increased for even lower qualities. The main point is that the quality be less than one as previously defined and have a lower limit that is sufficiently high that the desired heat rejection from the air to the refrigerant within the evaporator 38 occurs.

From the second flow path 28 of the suction line heat exchanger 26, the refrigerant is now passed at a relatively high quality, not necessarily, but preferably, substantially equal to one as previously defined, by a conduit 44 to a conventional accumulator 46 which in turn discharges through a conduit 48 to the inlet 14 of the compressor 10. Refrigerant leaving the accumulator 46 is at a quality that is substantially equal to one as previously defined. It is desirable, though not absolutely necessary, that the refrigerant entering the compressor inlet 14 be substantially at or slightly above its saturation temperature as opposed to a super heated temperature to reduce the heat loading on the compressor 10. However, in some cases super heated vapor may be present and tolerable in the system. It is also desirable, as is well known, that the quality be substantially equal to one so that liquid refrigerant in a quantity that is sufficient to damage the compressor 10 during the compression process is not present.

In conventional systems of this sort, it has been typical to place the accumulator 46 upstream of the second flow path 28 of the suction line heat exchanger 26 and downstream of the evaporator outlet 40. In such a conventional configuration, saturated refrigerant vapor enters the suction line heat exchanger 26 which then is superheated as a result of the heat exchange with the high pressure refrigerant stream exiting the gas cooler 16. Superheated refrigerant vapor has a lesser density than saturated vapor and consequently reduces the efficiency of the compressor. Thus system efficiency is increased by locating the accumulator 40 between the compressor inlet 14 and the second flow path 28 of the suction line heat exchanger 26 as in this embodiment of the invention.

A further efficiency occurs through use of the invention in the configuration illustrated in FIG. 1. With the suction line heat exchanger 26 located between the evaporator outlet 40 and the accumulator 46, the fact that two phase refrigerant, i.e., refrigerant having a quality less than one, is present in heat exchange relation with high pressure refrigerant received from the gas cooler 16, there is a greater reduction in the temperature of the compressed refrigerant as it exits the first flow path 24 because of a greater temperature drop along the first flow path 24. This reduction has the effect of reducing the quality of the refrigerant entering the evaporator 38 which in turn has the effect of reducing possible flow maldistribution within the evaporator for greater efficiency. This in turn has the effect of improving evaporator capacity because the evaporator is used more effectively with fewer regions seeing superheated vapor as well as improving air side temperature distribution of air driven by the fan 40 through the evaporator 38.

Furthermore, because the second flow path 28 receives two phase refrigerant, and refrigerant flow therein is two phase along at least part of its length, the second flow path 28 operates isothermally over much of its length. This means that the suction line heat exchanger is more effective since it does not materially contribute to refrigerant superheat entering the compressor 10 and has the beneficial effect of lowering the quality of the refrigerant entering the evaporator to provide improved evaporator capacity.

Figure 2:
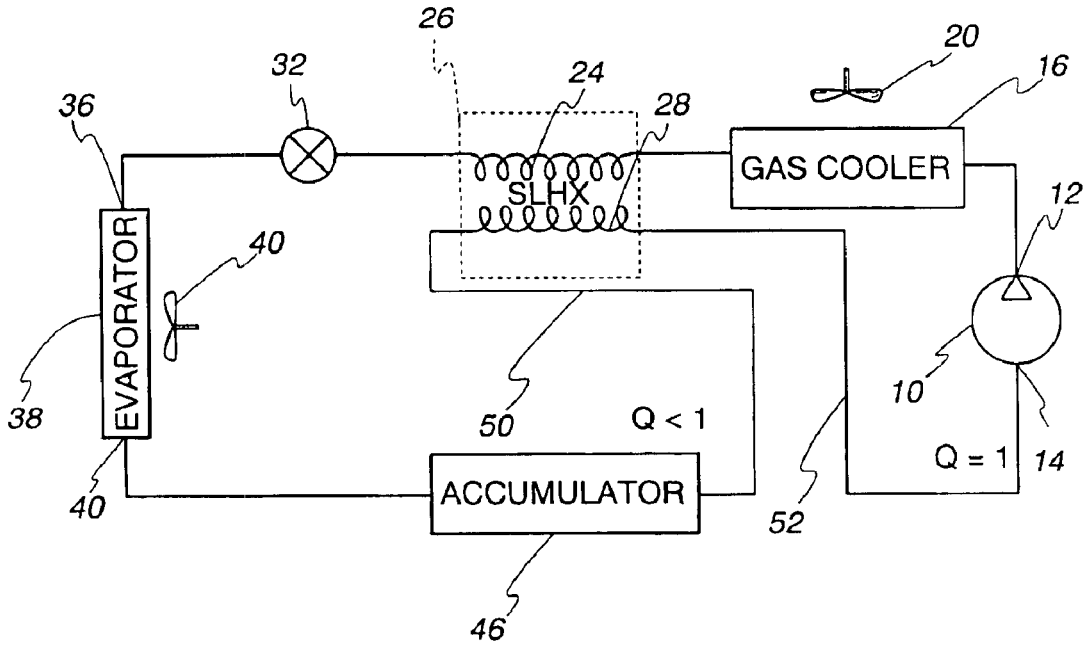
FIG. 2 is a schematic of a modified embodiment of the refrigeration system.

Turning now to FIG. 2, a highly preferred embodiment of the invention that provides a greater degree of control and regulation is described. Where like components are employed, like reference numerals are given.

In the embodiment illustrated in FIG. 2, the accumulator 46 is located between the evaporator outlet 40 and the second flow path 28 of the suction line heat exchanger 26. The suction line heat exchanger 26, and specifically, the second flow path 28 thereof, discharges into the inlet 14 of the compressor.

In this embodiment, refrigerant at a quality of less than 1 is placed in a conduit 50 that interconnects the outlet side of the accumulator 46 and the inlet side of the second flow path 28. Within the suction line heat exchanger's second flow path 28, any liquid phase refrigerant is evaporated so that refrigerant at a quality substantially equal to 1 or as a super heated vapor is flowed through a conduit 52 to the inlet 14 of the compressor 10. The embodiment of FIG. 2 is particularly useful in vehicular air conditioning systems. Such systems are typically optimized with the vehicle engine at idle speed. At idle speed, the mass flow rate of refrigerant through the vehicular air conditioning system is at a minimum and it is desired that it be sufficient so as to provide adequate cooling. At higher engine speeds, the mass flow rate of refrigerant is increased as compressor speed is increased and attaining the desired cooling is not a problem. Consequently, it is at an idle condition where greatest efficiency is required, i.e., it is at idle conditions where refrigerant in two phases, i.e., at a quality less than 1, is most required in the second flow path 28 of the suction line heat exchanger 26.

In order to assure that refrigerant at the desired quality less than 1 is placed in the conduit 50, the invention proposes certain modifications to the accumulator 46.

Figure 3:
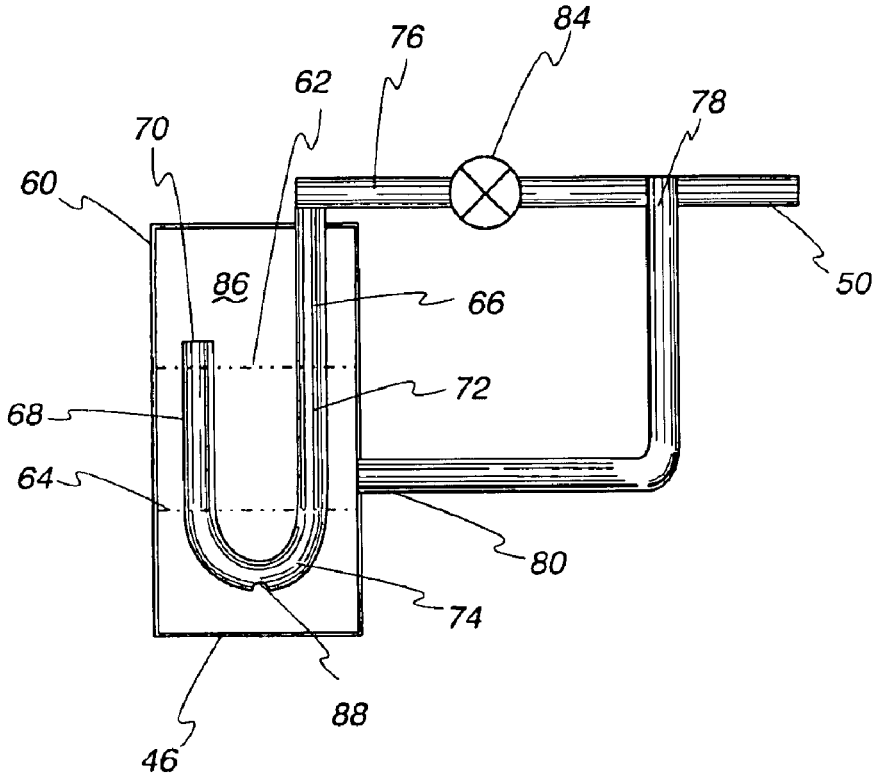
FIG. 3 is a somewhat schematic, sectional view of one type of accumulator and educing system that may be employed in the invention.

FIG. 3 shows one such modification.

In the usual case, the accumulator 46 includes a housing 60. Lines 62 and 64 within the housing, which in actual practice are imaginary, respectively designate the intended level of liquid refrigerant and the intended level of lubricant within the housing 60. A U or J-shaped tube 66 is located within the housing 60 and includes a first leg 68 having an open end 70 which is located above the intended level of liquid refrigerant 62. The tube 66 includes a second leg 72 which is connected to the first leg 68 by a bight 74. It will be noted that bight 74 is located below the intended level of lubricant 64 within the housing 60. The housing also includes an inlet (not shown).

The upper end of the leg 72 extends out of the housing 70 and is connected to a conduit 76 which extends to a tee 78. The tee 78 is connected the line 50 and extends to the second flow path 28 of the suction line heat exchanger 26 (FIG. 2).

The accumulator housing 60 also includes an outlet 80 that is located below the intended level of liquid refrigerant 62 and above the intended level of lubricant 64. The outlet 80 is also connected to the tee 50.

Finally, a fluid flow restriction 84, such as a valve, is located in the conduit 76 as illustrated in FIG. 3.

In operation, refrigerant is discharged into the accumulator 48 and to the extent it is in two phases, it will separate into vapor which will occupy a vapor space 86 above the intended level of liquid refrigerant 62 and liquid refrigerant which will occupy the volume between the two lines 62 and 64. Lubricant, conventionally carried by the refrigerant for purposes of lubricating the compressor 10 (FIGS. 1 and 2), settles to the bottom of the housing.

The bight 74 includes a small opening 88 below the intended level of lubricant 64.

In any event, refrigerant vapor will enter the tube 66 through the open end 70 and pass downwardly past the port 88 where it will entrain or educt lubricant from the housing 70 in the flowing refrigerant vapor stream to be carried to the compressor 10 to lubricate the same. At the same time, liquid refrigerant will be urged out of the outlet 80 to the tee 78 where it will mix with the refrigerant vapor and entrained lubricant which exits the upper end of the leg 72. The restriction 84 provides a desired regulation of the ratio of refrigerant vapor flow to liquid refrigerant flow to achieve the desired quality of refrigerant to be directed to the second flow path 28 of the suction line heat exchanger 26.

Figure 4:
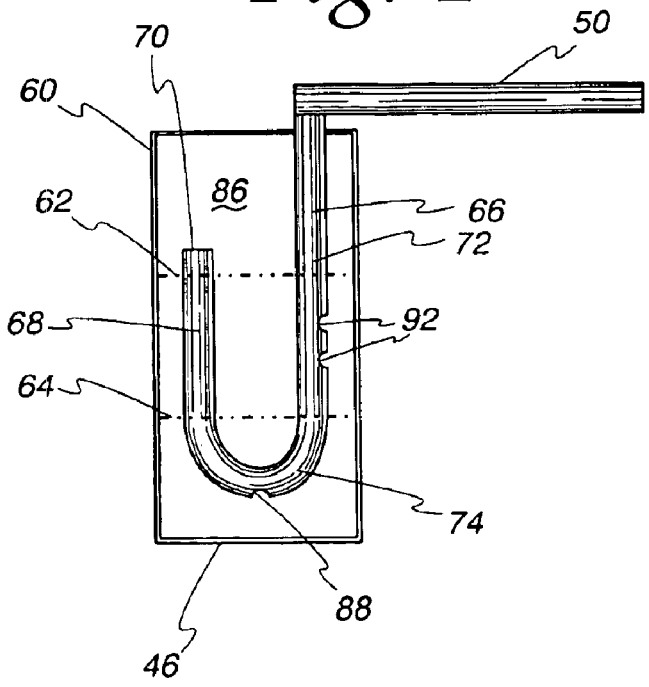
FIG. 4 is a somewhat schematic cross-sectional view of another form of accumulator and eduction system.

FIG. 4 shows a modified embodiment of an accumulator. Where identical components are employed, they are given the same reference numerals and will not necessarily be redescribed in the interest of brevity. In this embodiment, the outlet 80 is omitted in favor of one or more ports in the leg 72. The ports are given the reference numeral 92 and as can be appreciated from FIG. 4, are located below the intended level of liquid refrigerant 62 and above the intended level of lubricant 64. The ports 92 are simply small holes, much like the port 88 for the lubricant. As a consequence, when refrigerant vapor from the space 86 enters the open end 70 of the tube 66 and passes therethrough to the conduit 50, lubricant is entrained or educted at the port 88 and liquid phase refrigerant is educted or entrained into the vapor stream at the ports 92. Consequently, a stream emerges from the accumulator shown in FIG. 4 to the conduit 50 that has a quality less than 1.

The particular quality desired can be controlled by appropriate sizing of the ports 92 as well as by selection of the number of the ports 92.

The embodiment of FIG. 4 has the advantage over that shown in FIG. 3 in that the flow restriction 84 can be omitted along with the outlet 80 and the tee 78 to accomplish the same results with a relatively minor addition to a conventional accumulator. The ports 92 can be simple holes or may be angled in the direction of refrigerant flow to provide a venturi-like action.

Most interestingly, modern day accumulators in refrigeration systems are conventionally designed to prevent any liquid refrigerant from exiting the accumulator in order to protect the compressor from damage. In the embodiments illustrated in FIGS. 2, 3 and 4, the desired operation is just the opposite, namely, that the accumulator is designed to intentionally cause liquid refrigerant to leave the accumulator to be directed to the second flow path 28 of the suction line heat exchanger as a result of being educted by or entrained in the exiting flow of saturated refrigerant vapor to the suction line heat exchanger 26. The embodiments shown in FIGS. 3 and 4 provide simple and inexpensive means of accomplishing this function with the embodiment of FIG. 4 providing even greater simplicity than that of FIG. 3.

As a consequence of the invention, in any of its embodiments, two phase refrigerant, that is, a refrigerant having a quality of less than 1, is directed to the second flow path 28 or low pressure side of the suction line heat exchanger 26 to improve the efficiency of operation of the same by lowering the quality of the compressed refrigerant on the high pressure side that is flowing to the evaporator 38. Furthermore, because there is isothermal operation within the second flow path 28 over much of its length, refrigerant applied to the compressor inlet 14 is at a considerably lower temperature than in conventional systems. This provides advantages in terms of reducing the thermal load on the compressor 10 and is highly desirable in that thermal degradation of the lubricant typically contained in such systems is minimized or virtually eliminated altogether. Thus, not only is efficiency of operation of the entire system enhanced, but system Ion-gevity is increased as well.

What is claimed is:

1. A method of increasing the efficiency of a system including a vapor compression cooling cycle and having an evaporator with an inlet connected to an outlet of a gas cooler and an outlet connected to the inlet of a compressor, the compressor having an outlet connected to an inlet of the gas cooler and a suction line heat exchanger having two fluid flow paths in heat exchange relation with one another with one flow path being located between the evaporator inlet and the compressor outlet and the other flow path being located between the evaporator outlet and the compressor inlet, an accumulator downstream of said evaporator outlet and upstream of paid other flow path, and a refrigerant in said system that may exist as a vapor, a liquid or a mixture of vapor and liquid whose quality at a given point is defined as the weight ratio of the mass of refrigerant vapor to the combined mass of refrigerant vapor and liquid refrigerant at the given point, including the steps of:

(a) introducing refrigerant into said other flow path of said suction line heat exchanger at a quality less than 1; and (b) introducing refrigerant that has passed through said other flow path into said compressor inlet at a quality that is substantially equal to 1;

wherein said accumulator is characterized by a housing including a liquid refrigerant section and a refrigerant vapor section, a liquid outlet connected to said liquid refrigerant section, a vapor outlet connected to said refrigerant vapor section and a junction whereat said outlets are connected to each other to said other flow path.

2. The method of claim 1 wherein said system is further characterized by a flow restrictor disposed between said vapor outlet and said junction.

3. The method of claim 2 wherein said flow restrictor is a valve.

4. A method of increasing the efficiency of a system including a vapor compression cooling cycle and having an evaporator with an inlet connected to an outlet of a gas cooler and an outlet connected to the inlet of a compressor, the compressor having an outlet connected to an inlet of the gas cooler and a suction line heat exchanger having two fluid flow paths in heat exchange relation with one another with one flow path being located between the evaporator inlet and the compressor outlet and the other flow path being located between the evaporator outlet and the compressor inlet, an accumulator downstream of said evaporator outlet and upstream of said other flow path, and a refrigerant in said system that may exist as a vapor, a liquid or a mixture of vapor and liquid whose quality at a given point is defined as the weight ratio of the mass of refrigerant vapor to the combined mass of refrigerant vapor and liquid refrigerant at the given point, including the steps of:

(a) introducing refrigerant into said other flow path of said suction line heat exchanger at a quality less than 1; and (b) introducing refrigerant that has passed through said other flow path into said compressor inlet at a quality that is substantially equal to 1;

wherein said accumulator includes a housing having a liquid refrigerant section and a refrigerant vapor section and an outlet conduit therein which is connected to said other flow path, said conduit including a first opening in said liquid refrigerant section and upstream of a second opening in said refrigerant vapor section.

5. A method of increasing the efficiency of a system including a vapor compression cooling cycle and having an evaporator with an inlet connected to an outlet of a gas cooler and an outlet connected to the inlet of a compressor, the compressor having an outlet connected to an inlet of the gas cooler and a suction line heat exchanger having two fluid flow paths in heat exchange relation with one another with one flow path being located between the evaporator inlet and the compressor outlet and the other flow path being located between the evaporator outlet and the compressor inlet, and a refrigerant in said system that may exist as a vapor, a liquid or a mixture of vapor and liquid whose quality at a given point is defined as the weight ratio of the mass of refrigerant vapor to the combined mass of refrigerant vapor and liquid refrigerant at the given point, and an accumulator interposed between said other flow path and said evaporator outlet, said accumulator including both liquid refrigerant and refrigerant vapor, including the steps of:

(a) introducing refrigerant from said evaporator outlet into said accumulator;

(b) discharging refrigerant having a quality less than 1 from said accumulator into said other flow path by entraining or educting liquid refrigerant from said accumulator by refrigerant vapor exiting said accumulator to said compressor inlet, said step being performed within the accumulator; and (c) introducing refrigerant having a quality substantially equal to 1 from said other flow path into said compressor inlet.

6. A method of increasing the efficiency of a system including a vapor compression cooling cycle and having an evaporator with an inlet connected to an outlet of a gas cooler and an outlet connected to the inlet of a compressor, the compressor having an outlet connected to an inlet of the gas cooler and a suction line heat exchanger having two fluid flow paths in heat exchange relation with one another with one flow path being located between the evaporator inlet and the compressor outlet and the other flow path being located between the evaporator outlet and the compressor inlet, and a refrigerant in said system that may exist as a vapor, a liquid or a mixture of vapor and liquid whose quality at a given point is defined as the weight ratio of the mass of refrigerant vapor to the combined mass of refrigerant vapor and liquid refrigerant at the given point, and an accumulator interposed between said other flow path and said evaporator outlet, said accumulator including both liquid refrigerant and refrigerant vapor, including the steps of:

(a) introducing refrigerant from said evaporator outlet into said accumulator;

(b) discharging refrigerant having a quality less than 1 from said accumulator into said other flow path by entraining or educting liquid refrigerant from said accumulator by refrigerant vapor exiting said accumulator to said compressor inlet, said step being performed downstream of the accumulator; and (c) introducing refrigerant having a quality substantially equal to 1 from said other flow path into said compressor inlet.

7. A refrigeration system including a compressor having an inlet and an outlet, a gas cooler connected to said outlet to cool compressed refrigerant received from the compressor, an evaporator connected to the gas cooler for receiving cooled, compressed refrigerant therefrom, an accumulator connected to the evaporator to receive expanded refrigerant therefrom and to the compressor inlet and a suction line heat exchanger having a first refrigerant flow path interposed between the gas cooler and the evaporator and a second refrigerant flow path in heat exchange relation with said first refrigerant flow path and interconnecting the accumulator and the compressor inlet, and characterized by the accumulator including an inlet connected to the evaporator, a housing, including said accumulator inlet, for receipt of refrigerant in vapor, liquid or vapor/liquid form, a first housing outlet located to allow refrigerant vapor to exit the housing and a second outlet located to allow liquid refrigerant to exit the housing, said first and second outlets being connected to said second flow path and including different openings in a single tube.

8. The refrigeration system of claim 7 wherein said tube is a J or U-shaped tube located in said housing and having a short leg and a long leg with said first outlet being at or adjacent to an upper end of said short leg and said second outlet being one or more openings in said long leg and located vertically below said first outlet.

9. The refrigeration system of claim 8 further including a bight interconnecting lower ends of said short and long legs, and a lubricant exit hole in said bight vertically below said second outlet.

10. A refrigeration system including:

a compressor having an inlet and an outlet;

a gas cooler connected to said compressor outlet to cool compressed refrigerant received from the compressor;

an evaporator connected to the gas cooler for receiving cooled, compressed refrigerant therefrom;

an accumulator connected to said evaporator to receive refrigerant therefrom, said accumulator being a housing having an intended level of liquid refrigerant and a refrigerant vapor space above said intended liquid level of refrigerant, a first outlet from said accumulator disposed above said intended level of liquid refrigerant and a second outlet from said accumulator below said intended level of liquid refrigerant, said first and second outlets being in fluid communication with each other and with said compressor inlet; and a suction line heat exchanger in said system having a first refrigerant flow path interconnecting said gas cooler and said evaporator and a second refrigerant flow path in heat exchange relation with said first refrigerant flow path and interconnecting said accumulator and said compressor inlet and receiving refrigerant from the accumulator at a quality less than 1 and delivering the refrigerant to the compressor inlet at a quality substantially equal to 1, quality at a given point being defined as the weight ratio of the mass of refrigerant vapor to the combined mass of refrigerant vapor and liquid refrigerant at the given point.

11. The refrigeration system of claim 10 wherein said second outlet is disposed in a wall of said housing separate from said first outlet.

12. The refrigeration system of claim 10 wherein said accumulator includes a tube within said housing and both said outlets comprises respective inlet ports in said tube.

13. The refrigeration system of claim 12 wherein the inlet port defining said first outlet is upstream of the inlet port defining said second outlet.

14. The refrigeration system of claim 13 wherein said tube is a J or U-shaped tube having a first leg having said first outlet therein at a location above said intended level of liquid refrigerant and a second leg connected to said first leg by a bight and having said second outlet below said intended level of liquid refrigerant.

15. The refrigeration system of claim 14 wherein said accumulator includes an intended level of system lubricant below said intended level of refrigerant liquid and said bight is located below said intended level of system lubricant and includes a system lubricant inlet port therein.

* * * * *